US012324552B2

(12) United States Patent
Kremmel

(10) Patent No.: US 12,324,552 B2
(45) Date of Patent: Jun. 10, 2025

(54) DISHWASHING APPLIANCE AND METHODS OF OPERATION FOR FUTURE CYCLE PROTECTION

(71) Applicant: Haier US Appliance Solutions, Inc., Wilmington, DE (US)

(72) Inventor: Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 7 days.

(21) Appl. No.: 18/339,036

(22) Filed: Jun. 21, 2023

(65) Prior Publication Data

US 2024/0423440 A1 Dec. 26, 2024

(51) Int. Cl.
*A47L 15/00* (2006.01)
*A47L 15/42* (2006.01)

(52) U.S. Cl.
CPC ..... *A47L 15/0028* (2013.01); *A47L 15/0063* (2013.01); *A47L 15/4246* (2013.01); *A47L 15/4259* (2013.01); *A47L 2501/26* (2013.01); *A47L 2501/30* (2013.01)

(58) Field of Classification Search
CPC ..... A47L 15/0028; A47L 15/0063; A47L 15/4246; A47L 15/4259; A47L 2501/26; A47L 2501/30
See application file for complete search history.

(56) References Cited

U.S. PATENT DOCUMENTS

2011/0209729 A1* 9/2011 Beaudet ..... A47L 15/0021 134/18
2015/0265132 A1* 9/2015 Sohn ..... A47L 15/0049 134/57 DL
2017/0258290 A1* 9/2017 Fletty ..... H05B 47/155
2020/0397218 A1* 12/2020 Fawaz ..... A47L 15/4472
2021/0207306 A1* 7/2021 Koo ..... D06F 34/18
2022/0081825 A1 3/2022 Balinski et al.

FOREIGN PATENT DOCUMENTS

CN 108185942 B 11/2020
JP 2008036130 A 2/2007
JP 2014144099 A 8/2014
KR 101437180 B1 9/2014

* cited by examiner

*Primary Examiner* — Eric W Golightly
(74) *Attorney, Agent, or Firm* — Dority & Manning, P.A.

(57) ABSTRACT

A dishwashing appliance may include a cabinet, a tub, a door, a sensor assembly, and a controller. The tub may be mounted within the cabinet and define a wash chamber for receipt of articles for washing. The door may be movably mounted to the cabinet. The door may be movable between a latched position restricting access to the wash chamber and an unlatched position permitting access to the wash chamber. The sensor assembly may be mounted to the door to detect a position thereof. The controller may be configured to initiate a detection operation. The detection operation may include determining a future-use chamber cycle (FCC) to be initiated at a delayed time period, detecting the door in the unlatched position at the sensor assembly, generating a door-alert signal in response to detecting the door in the unlatched position, and restricting initiation of the FCC following generating the door-alert signal.

10 Claims, 4 Drawing Sheets

DISHWASHING APPLIANCE AND METHODS OF OPERATION FOR FUTURE CYCLE PROTECTION

FIELD OF THE DISCLOSURE

The present subject matter relates generally to a dishwashing appliance and methods to operate the same, such as when a future cycle is to be executed.

BACKGROUND OF THE DISCLOSURE

Dishwashing appliances or dishwashers generally include a cabinet or tub that defines a wash chamber for receipt of articles for washing. A door mounted to the cabinet provides selective access to the washing chamber. The door is normally mounted to the cabinet using hinges that allow the door to rotate between an open configuration and a closed configuration. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

Some existing appliances include a door lock and feature for preventing the dishwashing appliance from initiating a washing operation if the door is not locked or otherwise closed. Unfortunately, though, this can cause problems for a user. In particular, a user may be unaware that the door is open at the moment a washing operation would otherwise start. This may be especially frustrating if a user unlatches or opens the door and forgets to latch or close the door while intending for the washing operation to start later.

As a result, dishwashing appliances or assemblies addressing one or more of the above issues would be useful. In particular, it would be advantageous to provide a dishwashing appliance or assembly capable of preventing a user from missing an expected or desired washing operation.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a method of operating a dishwashing appliance is provided. The method may include determining a future-use chamber cycle (FCC) to be initiated at a delayed time period. The method may also include detecting a door in an unlatched position. The method may further include generating a door-alert signal in response to detecting the door in the unlatched position. The method may still further include restricting initiation of the FCC following generating the door-alert signal.

In another exemplary aspect of the present disclosure, a dishwashing appliance is provided. The dishwashing appliance may include a cabinet, a tub, a door, a sensor assembly, and a controller. The tub may be mounted within the cabinet and define a wash chamber for receipt of articles for washing. The door may be movably mounted to the cabinet. The door may be movable between a latched position restricting access to the wash chamber and an unlatched position permitting access to the wash chamber. The sensor assembly may be mounted to the door to detect a position thereof. The controller may be operably coupled to the sensor assembly. The controller may be configured to initiate a detection operation. The detection operation may include determining a future-use chamber cycle (FCC) to be initiated at a delayed time period, detecting the door in the unlatched position at the sensor assembly, generating a door-alert signal in response to detecting the door in the unlatched position, and restricting initiation of the FCC following generating the door-alert signal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
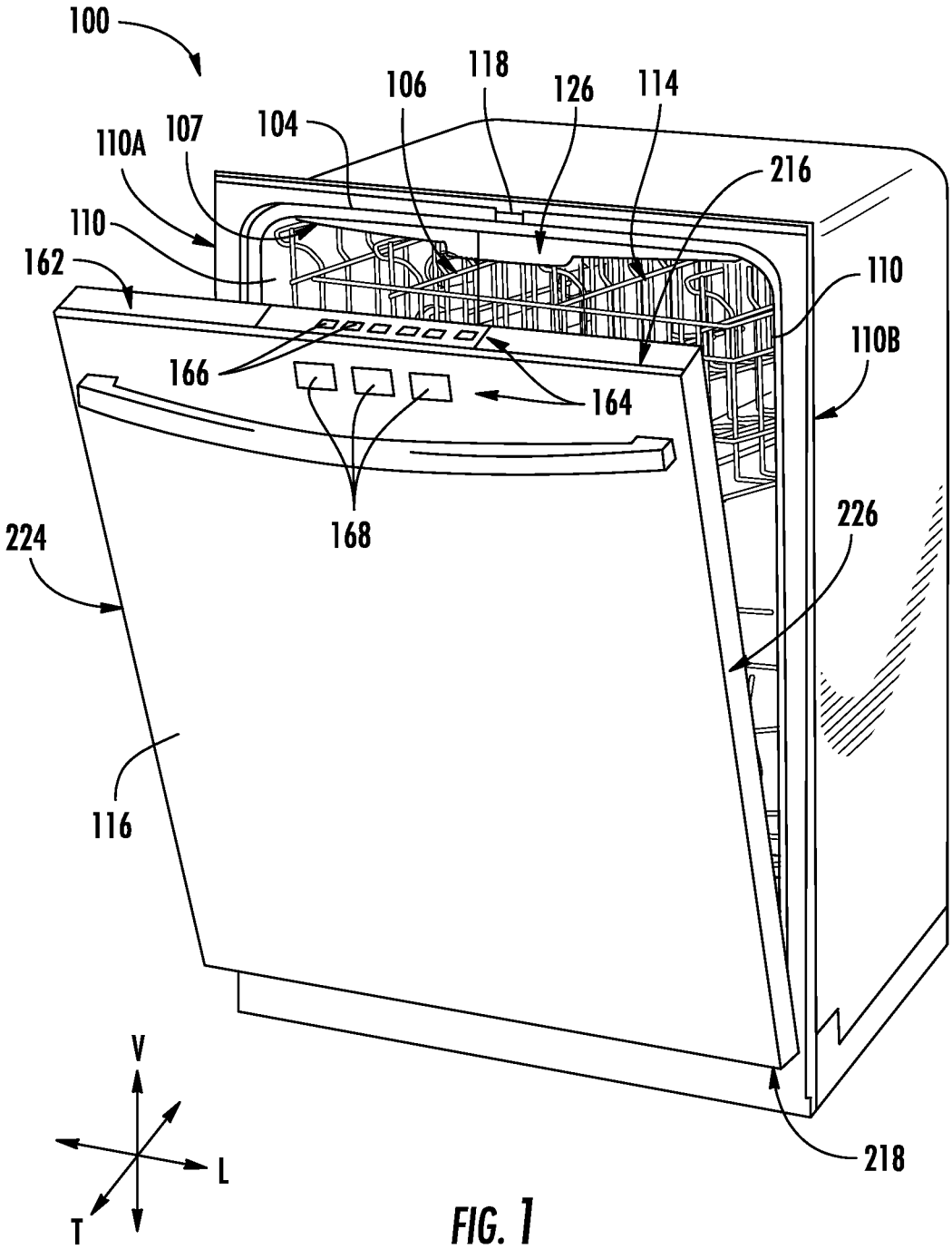
FIG. 1 provides a perspective view of a dishwashing appliance, including a dishwasher door according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, e.g., to remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance or heat is generated within the wash chamber.

Figure 2:
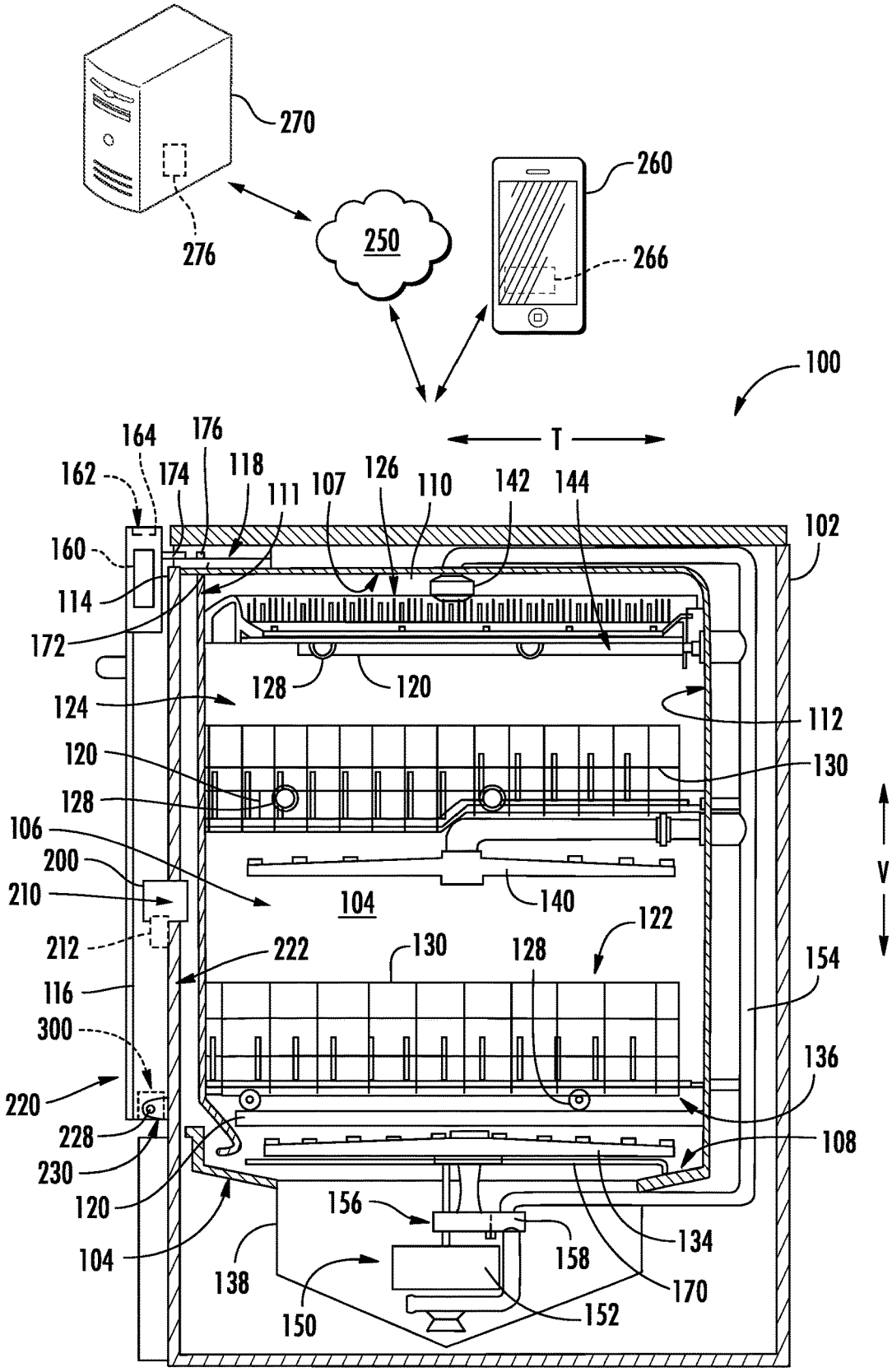
FIG. 2 provides a side cross-sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 that is generally configured for containing or supporting various components of appliance 100 and which may also define one or more internal chambers (e.g., wash chamber 106) or compartments of appliance 100. For instance, cabinet 102 may have or include a tub 104 that defines a wash chamber 106 therein. As used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, insulation material(s), or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

As shown, tub 104 extends between a top 107 and a bottom 108 along a vertical direction V, between a pair of sides or sidewalls 110 along a lateral direction L, and between a front side 111 and a rear side 112 along a transverse direction T. Each of the vertical direction V, lateral direction L, and transverse direction T are mutually orthogonal to one another.

Figure 3C:
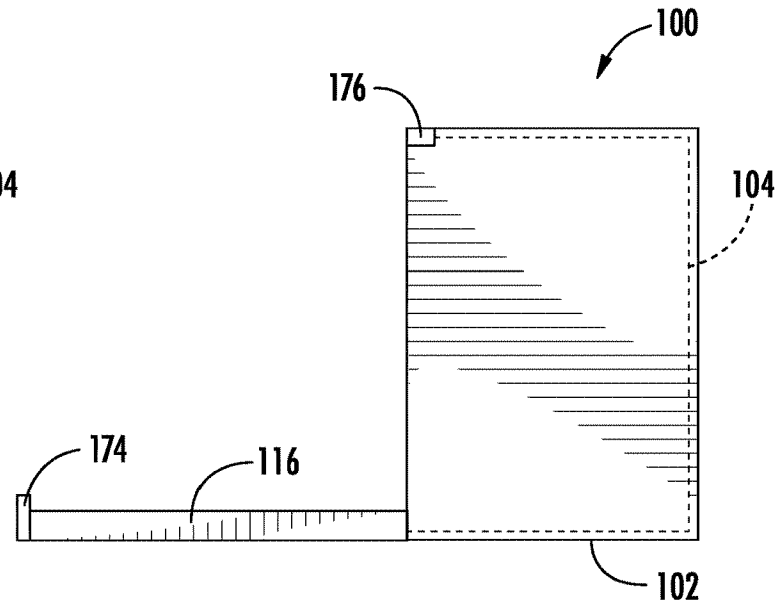
FIG. 3C provides a schematic elevation view of the exemplary dishwashing appliance of FIG. 1, wherein the door is in an open position.
Figure 3B:
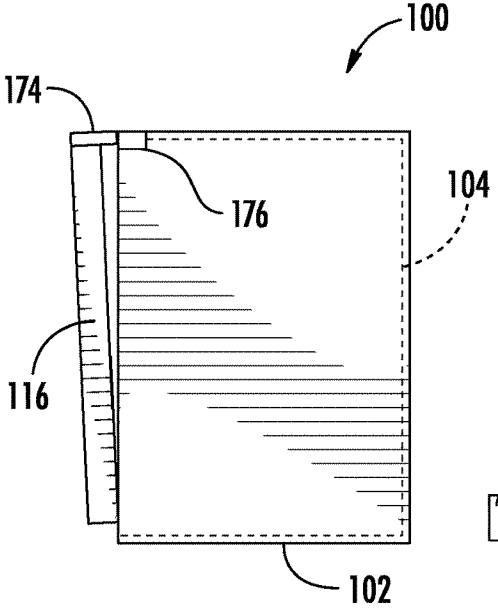
FIG. 3B provides a schematic elevation view of the exemplary dishwashing appliance of FIG. 1, wherein the door is in an intermediate position.
Figure 3A:
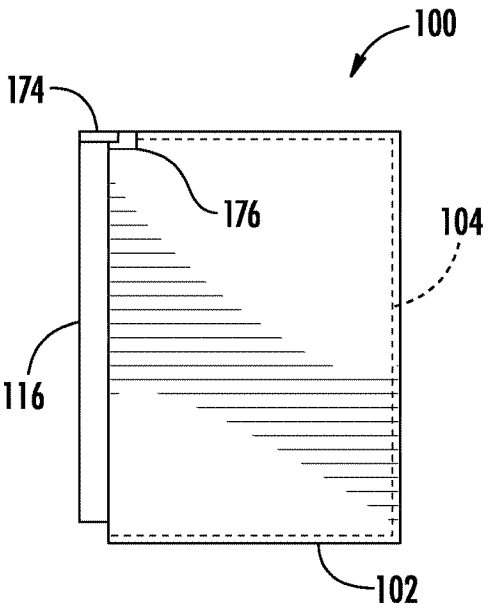
FIG. 3A provides a schematic elevation view of the exemplary dishwashing appliance of FIG. 1, wherein the door is in a closed position.

The tub 104 includes a front opening 114 and a door 116 hinged at its bottom for movement between a normally closed (e.g., vertical) position (e.g., FIGS. 2 and 3A), wherein the wash chamber 106 is sealed shut for washing operation, and a fully opened (e.g., horizontal) position (e.g., FIG. 3C) for loading and unloading of articles from the dishwasher 100. In the normally closed position, door 116 extends from a top end 216 to a bottom end 218 along the vertical direction V; from a front end 220 to a rear end 222 along the transverse direction T; and between two lateral edges or ends 224, 226 along the lateral direction L. A rotation axis 228 may be defined on the door 214 (e.g., by one or more lateral pivot hinges or pins), for example, parallel to the lateral direction L at or proximal to bottom end 218. According to exemplary embodiments, dishwasher 100 further includes a door closure mechanism or assembly 118 that is used to lock and unlock door 116 for accessing and sealing wash chamber 106.

As illustrated in FIG. 2, tub sidewalls 110 may accommodate a plurality of rack assemblies. For instance, guide rails 120 may be mounted to sidewalls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 may be fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwashing appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwashing appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

In some embodiments, an additive module 200 is provided at or on an inner portion of door 116 to receive and dispense a volume of wash additive (e.g., rinse aid, liquid cleaning agent, etc.) to the wash chamber 106 (e.g., from an additive compartment 210), as is generally understood. For instance, an additive module 200 may be attached to the inner wall of the door 116. A hole or aperture defined through the inner wall may receive or otherwise define an opening for fluid communication with the reservoir or additive compartment 210 of the additive module 200. Thus, additive module 200 may be fixed to the door 116 and thereby move with the door 116 (e.g., as it is moved between the open and closed positions).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. For certain embodiments, the instructions include a software package configured to operate appliance 100, such as according to one or more programmed cycles methods (e.g., 400 described below). The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The memory devices may also store data that can be retrieved, manipulated, created, or stored by the one or more processors or portions of controller 160. The data can include, for instance, data to facilitate performance of methods described herein. The data can be stored locally (e.g., on controller 160) in one or more databases or may be split up so that the data is stored in multiple locations. In addition, or alternatively, the one or more database(s) can be connected to controller 160 through any suitable network(s), such as through a high bandwidth local area network (LAN) or wide area network (WAN). In this regard, for example, controller 160 may further include a communication module or interface that may be used to communicate with one or more other component(s) of appliance 100, controller 160, an external appliance controller, or any other suitable device, e.g., via any suitable communication lines or network(s) and using any suitable communication protocol. The communication interface can include any suitable components for interfacing with one or more network(s) (e.g., remote network 250), including for example, transmitters, receivers, ports, controllers, antennas, or other suitable components. In this manner, controller 160 may further be in communication (e.g., wireless communication) with a remote user device 260, in some embodiments, and as will be described below.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed, for example, through the bottom of door 116. Typically, the controller 160 includes a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electro-mechanical input devices including rotary dials, push buttons, and touch pads. As shown, one or more user inputs 166 (e.g., buttons) of user interface 164 may be positioned at a top end 216 of door 116 (e.g., on or through a top wall of door 116). The user interface 164 may further include one or more display components 168, such as a digital display device or one or more indicator light assemblies (e.g., selectively illuminated elements) designed to provide operational feedback to a user. The user interface 164 may be in communication with the controller 160 via one or more signal lines or shared communication busses.

In some embodiments, a heating element 170 is operably coupled (e.g., electrically coupled) to the controller 160 to selectively provide heat to the wash chamber 106 (e.g., during a drain cycle). For example, heating element 170 may be provided as a resistive or sheathed heating element 170 (e.g., CALROD®) mounted to a bottom portion of tub 104. In some such embodiments, heating element 170 is attached to a bottom wall 108 within the sump 138 or wash chamber 106.

Nonetheless, heating element 170 may include or be provided any suitable heater for heating wash chamber 106 (e.g., to dry articles therein), as is generally understood. During use, the controller 160 may thus transmit one or more heating signals (e.g., as an electrical current) in order to activate heating element 170 and initiate the generation of heat therefrom.

It should be appreciated that the present disclosure is not limited to any particular style, model, or configuration of dishwasher 100. The exemplary embodiment depicted in FIGS. 1 through 3C is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present disclosure.

As noted above, a latch assembly 118 is included in some embodiments. Generally, latch assembly 118 may serve to selectively hold door 116 closed (e.g., in a latched position) and may include a separate latch 174 (e.g., proximal to or mounted at a top portion of door 116) and catch 176 (e.g., disposed at or above top 107). As shown, latch 174 may generally extend rearward, such as from an inner or rearward-facing surface of door 116 and toward the cabinet 102. When closed or otherwise in the in the closed position (e.g., fully closed or latched position-FIG. 2), latch 174 may be received within a cavity or catch 176 of cabinet 102 (e.g., such that latch is locked within cabinet 102).

In certain embodiments, door latch 118 includes a lock actuator or motor 172 to selectively move or motivate door 116, such as between the closed position and an unlatched or open (e.g., partially open) position. For instance, lock motor 172 may be in selective mechanical communication with a latch 174 or another suitable portion of door 116 (e.g., proximal to a top portion thereof). Moreover, lock motor 172 may engage latch 174 such that lock motor 172 is able to motivate (e.g., push or pull) latch 174, and thus door 116, forward/rearward relative to a top portion of tub 104 or cabinet 102.

In some embodiments, latch assembly 118 is in operative (e.g., electrical or wireless) communication with controller 160. Controller 160 may be configured to detect door 116 in the latched or closed position, such as through an include mechanical or electrical (e.g., magnetic) reed switch that transmits a closed door signal (e.g., to controller 160) in response to engagement therewith by the door 116. In some such embodiments, closure assembly 118 includes a first contact mounted to tub 104 and a second contact mounted to door 116 (e.g., to rotate therewith). For instance, the first contact may provide a rail or catch (e.g., catch 176) that receives or contacts the second contact (e.g., latch 174) when door 116 is in the latched or closed position.

In optional embodiments, lock motor 172 may be in operative (e.g., electrical or wireless) communication with controller 160. Moreover, lock motor 172 may include any suitable motor or actuator for translating or pivoting the door 116 (e.g., as directed by controller 160). Thus, controller 160 may be configured to direct door 116 between, for example, the latched or closed position and an unlatched or partially open (e.g., vent) position.

It is noted that although the illustrated embodiments include a motorized latch assembly 118, the present disclosure is not necessarily limited by the presence of lock motor 172. Alternative embodiments may include a manual assembly in which a user-actuated member (e.g., bar) selectively moves the latch between a latched position or unlatched position, as would be understood.

In optional embodiments, separate from or in addition to latch assembly 118, a position sensor or sensor assembly 300 is provided on or in communication with door 116. In other words, a sensor assembly 300 that includes or, alternatively, is distinct from latch assembly 118 may be configured to detect movement or one or more rotational positions of door 116. Sensor assembly 300 may be configured to detect one or more predetermined positions of door 116 about its rotation axis 228. For instance, sensor assembly 300 may be in communication (e.g., electric or wireless communication) with controller 160 to generate one or more signals indicating the rotational position that door 116 is currently in or has recently reached. Sensor assembly 300 may thus detect or determine if door 116 is in the closed position (e.g., FIG. 3A), fully opened position (e.g., FIG. 3C), or one or more intermediate positions (e.g., a partially open position-FIG. 3B) between the closed position and the fully opened position.

Optionally, sensor assembly 300 may be or include an accelerometer, which measures translational motion along one or more directions. Additionally or alternatively, sensor assembly 300 may be or include a gyroscope, which measures rotational motion or position about an axis. Also additionally or alternatively, sensor assembly 300 may be or include contact switch to selectively contact latch 174 (e.g., in the closed position or open-vent position). In some such embodiments, closure assembly 118 includes a first contact 176A mounted to tub 104 and a second contact 176B mounted to door 116 (e.g., to rotate therewith). For instance, the first contact 176A may provide a rail or catch that receives or contacts the second contact 176B (e.g., latch 174) when door 116 is in the closed position or open-vent position.

Further additionally or alternatively, sensor assembly 300 may be or include another suitable device capable of detecting or measuring an angle of door 116 relative to the vertical direction V, such as a potentiometer (e.g., mounted at the hinge of door 116), a limit switch (e.g., mechanical or magnetic switch in selective engagement with the door 116 at a set position or threshold), a rotary encoder (e.g., optical sensor, a Hall effect sensor, etc.), a load cell, or a strain gauge.

In some embodiments, an additive sensor 212 is provided on, in, or otherwise in operable communication with additive module 200. Generally, additive sensor 212 may configured to detect a volume or presence of additive within the additive compartment 210. For instance, additive sensor 212 may be in communication (e.g., electric or wireless communication) with controller 160 to generate one or more signals indicating the relative volume (or binary presence-absence) of additive within additive compartment 210. In turn, it may be determined if and when an additive (e.g., detergent, rinse agent, etc.) is actually supplied to additive compartment 210. Generally, additive sensor 212 may include any suitable sensing assembly for detecting an additive therein. For instance, the additive sensor 212 may include or be provided as a pressure sensor, capacitance sensor, resistance sensor, etc. configured to detect an additive within compartment 210, as would be understood.

In some embodiments, appliance 100 (e.g., by use of controller 160) may further be configured to communicate with one or more separate, external devices, such as a remote user device (e.g., remote user device 260) or a remote server (e.g. remote server 270). Such communication may be performed either directly or via one or more intermediate networks (e.g., a wide area network 250, such as the internet), as will be discussed in more detail below.

In general, a remote user device 260 may be any suitable device separate from appliance 100 that is configured to provide or receive communications, information, data, or commands from a user. In this regard, remote user device 260 may be, for example, a personal phone, a smartphone, a tablet, a laptop or personal computer, a wearable device, a smart home system, or another mobile or remote device.

In some embodiments, remote user device 260 may include a device controller 266 and a network interface. Device controller 266 may include one or more processors and one or more memory devices (i.e., memory). The one or more processors can be any suitable processing device (e.g., a processor core, a microprocessor, an ASIC, a FPGA, a microcontroller, etc.) and can be one processor or a plurality of processors that are operatively connected. The memory device can include one or more non-transitory computer-readable storage mediums, such as RAM, ROM, EEPROM, EPROM, flash memory devices, magnetic disks, etc., and combinations thereof. The memory devices can store data and instructions that are executed by the processor to cause the remote user device 260 to perform operations. For example, instructions could be instructions for directing a response action at household appliance 100, displaying an alert on a user interface or display of remote user device 260, downloading software applications, implementing software applications, etc. The memory devices may also include data, such as identification data corresponding to the individual remote user device, stored blockchain files, stored software files, etc., that can be retrieved, manipulated, created, or stored by processor.

Remote user device 260 may include a network interface such that remote user device 260 can connect to and communicate over one or more networks (e.g., network 250) with one or more network nodes. Network interface can be an onboard component of device controller 266 or it can be a separate, off board component. Device controller 266 can also include one or more transmitting, receiving, or transceiving components for transmitting/receiving communications with other devices communicatively coupled across remote network 250. Additionally or alternatively, one or more transmitting, receiving, or transceiving components can be located off board device controller 266.

In certain embodiments, a remote server 270 is in communication with appliance 100 or remote user device 260 (e.g., through remote network 250). In this regard, for example, remote server 270 may be a cloud-based server, and is thus located at a distant location, such as in a separate state, country, etc. According to an exemplary embodiment, remote user device 260 may communicate with a remote server 270 over remote network 250, such as the Internet, to transmit/receive data or information, provide user inputs, receive user notifications or instructions, interact with or control appliance 100, etc. In addition, remote user device 260 and remote server 270 may communicate with appliance 100 to communicate similar information.

In general, communication between appliance 100, remote user device 260, remote server 270, or other user devices 260 or appliances may be carried using any type of wired or wireless connection and using a suitable type of communication network, non-limiting examples of which are provided below. For example, remote user device 260 may be in direct or indirect communication with appliance 100 through any suitable wired or wireless communication connections or interfaces, such as network 250. For example, network 250 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

In some embodiments, a remote server 270, such as a web server, is in operative communication with remote user device 260. The remote server 270 can be used to host an information database (e.g., software applications). The remote server 270 can be implemented using any suitable computing device(s). In some embodiments, remote server 270 includes a server controller 276. Server controller 276 may include one or more processors and one or more memory devices (i.e., memory). The one or more processors can be any suitable processing device (e.g., a processor core, a microprocessor, an ASIC, a FPGA, a microcontroller, etc.) and can be one processor or a plurality of processors that are operatively connected. The memory device can include one or more non-transitory computer-readable storage mediums, such as RAM, ROM, EEPROM, EPROM, flash memory devices, magnetic disks, etc., and combinations thereof. The memory devices can store data and instructions which are executed by the processor to cause remote server 270 to perform operations. For example, instructions could be instructions for receiving, interpreting, or sending a data file, downloading software applications, implementing software applications, etc. The data can be stored in one or more databases. The one or more databases can be connected to remote server 270 by a high bandwidth LAN or WAN or can also be connected to remote server 270 through remote network 250. The one or more databases can be split up so that they are located in multiple locales.

Remote server 270 includes a network interface such that remote server 270 can connect to and communicate over one or more networks (e.g., remote network 250) with one or more network nodes. Network interface can be an onboard component or it can be a separate, off board component. In turn, remote server 270 can exchange data with one or more nodes over the remote network 250. In particular, remote server 270 can exchange data with remote user device 260. Although not pictured, it is understood that remote server 270 may further exchange data with any number of client devices over the network 250. The client devices can be any suitable type of computing device, such as a general-purpose computer, special purpose computer, laptop, desktop, integrated circuit, mobile device, smartphone, tablet, or other suitable computing device.

Figure 4:
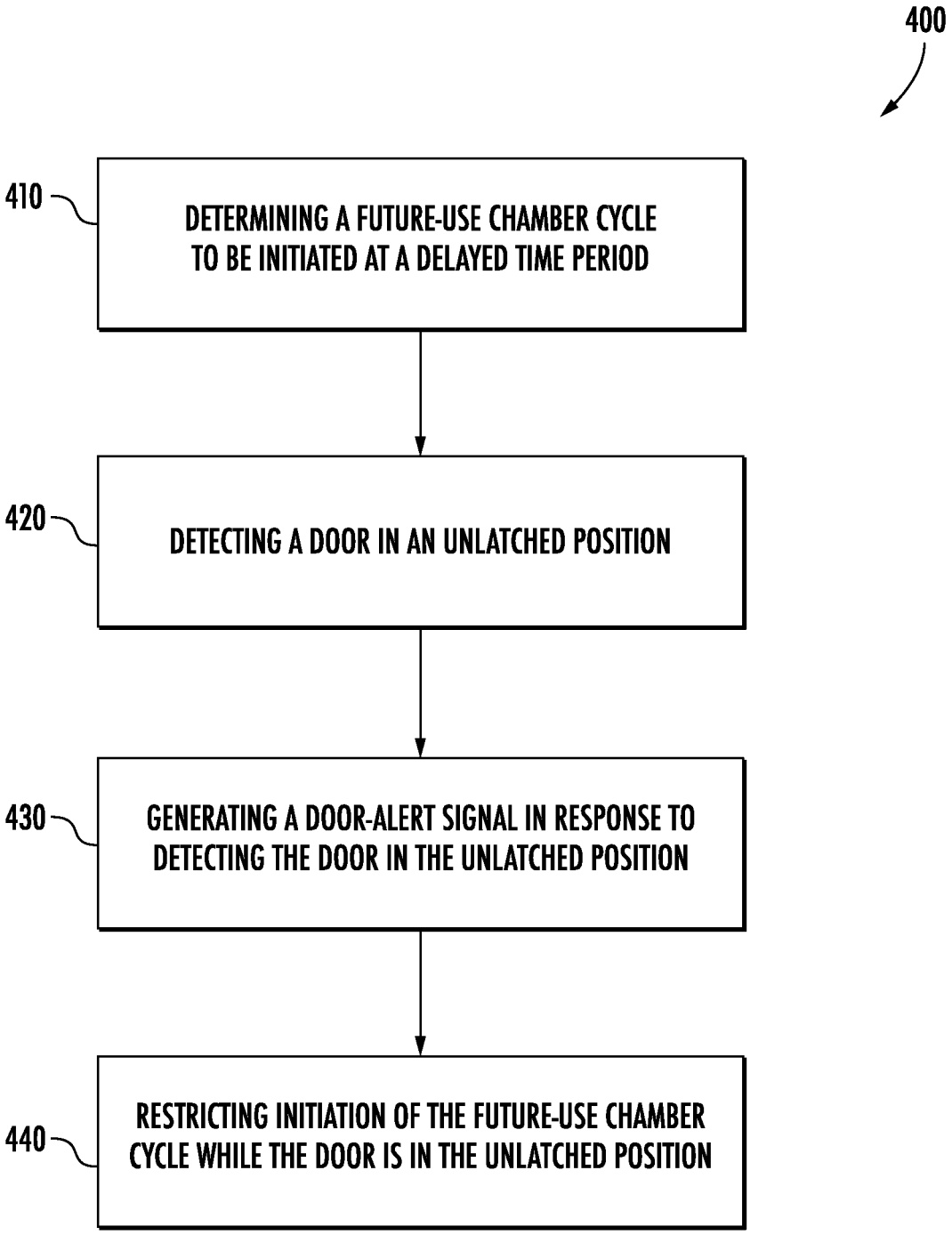
FIG. 4 provides a flow chart illustrating a method of operating a dishwashing appliance according to exemplary embodiments of the present disclosure.

Turning now to FIG. 4, exemplary methods (e.g., the method 400) for operating a dishwashing appliance are illustrated. As an example, method 400 may be used to operate any suitable dishwashing appliance, such as between washing operations or after a discrete washing operation (e.g., in which water or wash fluid is circulated through one or more spray assemblies as part of a rinse or wash cycle; and which may further include a drain cycle) has already been completed (e.g., such that articles within wash chamber 106 have been sprayed with water or wash fluid and which may be followed by a drain cycle). In particular, the method 400 may be used to operate dishwashing appliance 100 (FIG. 1). The controller 160, device controller 266, or server controller 276 may be programmed or otherwise configured to implement some or all of the method 400.

Advantageously, appliances or assemblies in accordance with the above-described embodiments may reliably ensure a user doesn't miss an expected or desired washing operation.

At 410, the method 400 includes determining a future-use chamber cycle (FCC) to be initiated at a delayed time period. Specifically, it may be determined that at a particular time in the future (e.g., a delayed time period), a new cycle (e.g., FCC), such as a rinse cycle, wash cycle, or drain cycle is set or likely to be initiated within the appliance. Although the delayed time period may be variable, it is understood that the delayed time period may be understood as not being immediately imminent from the time of determination. For instance, the delayed time period may be greater than 5 minutes, greater than 15 minutes, greater than 30 minutes, or greater than an hour from the time of determination. Additionally or alternatively, the delayed time period may be less than 48 hours, less than 24 hours, or less than 12 hour from the time of determination.

Optionally, the determination at 410 may be initiated following expiration or completion of a previous chamber cycle (e.g., previous wash cycle, rinse cycle, or drain cycle). Thus, prior to 410 a cycle-expiration determination may be made, as is generally understood.

In some embodiments, the FCC includes or is provided as an automated rinse cycle. For instance, the FCC may include a rinse cycle to be performed according to a set schedule, formula, chart, or graph. The automated rinse cycle may be agnostic of any load presence. Thus, the automated rinse cycle may be indifferent to or independent of the presence of any articles or load within the wash chamber. Notably, the automated rinse cycle may ensure the wash chamber is regularly or routinely rinsed. In other words, water or wash fluid may be circulated through the spray assemblies and wash chamber (e.g., as described above), thereby preventing the growth of bacteria, microbes, or other conditions that might otherwise facilitate odors within the wash chamber between user-initiated washing operations or cycles.

The automated rinse cycle or FCC may have a set time interval of inaction within the wash chamber. For instance, the automated rinse cycle may be set or programmed to initiate in response to expiration of the set time interval after a previous chamber cycle. Thus, after a discrete chamber cycle is performed, the set time interval may be measured (i.e., such that expiration of the set time interval is detected). Following expiration of the set time interval (e.g., detection thereof), the automated rinse cycle may be set or scheduled to initiate. In some embodiments, the delayed time period is at expiration of the set time interval. In turn, 410 may include determining expiration of the set time interval (e.g., following a determination that a previous chamber cycle is completed).

In additional or alternative embodiments, the FCC includes or is provided as a delayed wash cycle. For instance the FCC may include a wash cycle, rinse cycle, or drain cycle to be performed following a set delay interval. The set delay interval may be a user-selected interval (e.g., input at a user interface of the appliance or remote user device). In other words, a user may choose a specific future time (or amount of time in the future) at which the user wishes for the chamber cycle to start. The delayed time period may, thus, be the determined time at which the set delay period expires. In certain embodiments, 410 includes receiving a user-input signal from a user interface of the dishwashing appliance to manually schedule the delayed wash cycle.

In further additional or alternative embodiments, the FCC includes or is provided as a predicted wash cycle. For instance, the FCC may include a wash cycle, rinse cycle, or drain cycle that is likely to be initiated (e.g., by a user) based on past habits or routines of a user. In particular, past cycles or use events (e.g., in which a chamber cycle is initiated by a user's command or input) may be recorded as past-use data. Such past-use data may then be evaluated (e.g., on the appliance or remote server according to existing predictive formulas, programs, or techniques) to identify a common cycle time (e.g., time of day, day of the week, etc.) in which a user regularly initiates a chamber cycle or is otherwise statistically likely to initiate a chamber cycle. Optionally, the past-use data evaluations analysis may include utilizing artificial intelligence ("AI"), such as a machine learning process, a neural network classification module, any other suitable artificial intelligence (AI) technique, or any other suitable image analysis techniques. Moreover, multiple processes may be used independently, collectively, or interchangeably to extract detailed information regarding the past-use data being analyzed to facilitate performance of the overall predictive analysis to otherwise improve appliance operation. According to exemplary embodiments, any suitable number and combination of data processing, pattern recognition, or other image analysis techniques may be used to obtain an accurate analysis of the obtained past-use data.

The automated rinse cycle or FCC may have or be matched to the common cycle time. For instance, based on past-use data, it may be determined that the FCC is likely to be initiated or requested by a user at the common cycle time. In some such embodiments, the delayed time period is at or matches the delayed time period. In turn, 410 may include evaluating past-use data of the dishwashing appliance and identifying a common cycle time based on the evaluation of the past-use data before matching or selectively the common cycle time to the delayed time period.

At 420, the method 400 includes detecting the door in an unlatched position (e.g., prior to the delayed time period). For instance, 420 may follow 410, but occur before the delayed time period is reached. Optionally, 420 may be in response to 410. Generally, detection of the door at the unlatched position may be made based on a signal received from one or more sensors or sensor assemblies (e.g., as described above). In some embodiments, the unlatched position includes or is provided as an open position of the door. For instance, detecting the door as being at least partially open may also (e.g., necessarily) provide for detecting the door is not latched. Thus, one or more sensor assembly may detect that the door is not in the closed position (e.g., in a partially or fully open position) and transmit a signal corresponding to the same, as described above. In additional or alternative embodiments, the unlatched position includes or is provided as an unlocked position of the door. Such a determination may be based, at least in part, on a signal received from the latch assembly. For instance, 420 may include detecting a latch member apart from a catch member, as described above.

In optional embodiments, separate from or in addition to detecting the door in the unlatched position, 420 may include determining an unloaded detergent condition within the dishwashing appliance (e.g., prior to 430). For instance, one or more detergent sensors (e.g., in communication with an additive compartment) may detect an absence of additive (e.g., detergent or cleaning agent) within the additive compartment. It is noted that the unloaded condition may be in contrast to a loaded condition wherein a volume or presence of additive is detected within the additive compartment, as described above. Thus, failing to detect a loaded condition may result in detection of an unloaded condition.

At 430, the method 400 includes generating a door-alert signal (e.g., based on or in response to 420). Generally, the door-alert signal is configured to initiate an alarm or alert action at a user interface (e.g., of the dishwashing appliance or the remote user device). The alarm or alert action may specifically indicate or communicate to a user (e.g., directly or indirectly) that the door is unlatched or that the FCC may not be permitted unless the door is latched. The alarm or alert action may be visual or auditory in nature. Optionally, the door-alert signal and subsequent alarm or alert may be generated immediately (e.g., without a prescribed time delay) following 420.

In some embodiments, the door-alert signal is configured to initiate a visual alert at the user interface of the dishwashing appliance (e.g., on a display screen or one or more selectively illuminated elements on the door of the appliance). As an example, a message stating the unlatched status of the door may be displayed. As an additional or alternative example, one or more discrete icons or lights of the user interface may be illuminated according to a predetermined pattern or color corresponding to an unlatched position of the door.

In additional or alternative embodiments, the door-alert signal is configured to initiate an audible alert at the user interface of the appliance. As an example, a pre-recorded audio message may be played at a speaker of the appliance to state that the door is unlatched. As an additional or alternative embodiments, one or more discrete chirps, whistles, or beeps may be generated according to a predetermined pattern or tone corresponding to an unlatched position of the door.

In further additional or alternative embodiments, the door-alert signal is configured to initiate a visual alert at the user interface of a remote user device (e.g., on a display screen of the remote user device). As an example, a message stating the unlatched status of the door may be displayed (e.g., via a push notification or dedicated application or program running on the user device).

In embodiments, wherein 420 includes a determination of the unloaded condition, 430 may include generating a detergent alert signal in response to determining the unloaded detergent condition within the dishwashing appliance. Similar to the door-alert signal, the detergent alert signal may be configured to initiate an alarm or alert action at a user interface (e.g., of the dishwashing appliance or the remote user device). Such an alarm or alert action may specifically indicate or communicate to a user (e.g., directly or indirectly) that the additive module is not loaded or that the FCC may not be permitted unless additive is provided. Again, the alarm or alert action may be visual or auditory in nature. Optionally, the detergent alert signal and subsequent alarm or alert may be generated immediately (e.g., without a prescribed time delay) following 420.

At 440, the method 400 includes restricting initiation of the FCC following generating the door-alert signal. In other words, the FCC may be prevented from being initiated at 440 (e.g., even if the delayed time period is reached or an input/prompt is received from the user or user interface). For instance, at 440, the appliance may be directed to a lock-out mode in which initiation of a chamber cycle is prevented. Optionally, 430 or the alert prompted thereby may continue during 440.

In some embodiments, 440 may continue while (e.g., so long as) the door remains in the unlatched position. In certain embodiments, following 440, the method 400 may include detecting the door in a latched position. For instance, detection of the door at the latched position may be made based on a signal received from one or more sensors or sensor assemblies (e.g., as described above). In some embodiments, the latched position includes or is provided as a closed position of the door (e.g., detected at the sensor assembly or latch assembly). In additional or alternative embodiments, the latched position includes or is provided as a locked position of the door (e.g., detected at the latch assembly, such as by engagement between the latch member and the catch member, as described above).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:

a cabinet;

a tub mounted within the cabinet and defining a wash chamber for receipt of articles for washing;

a door movably mounted to the cabinet, the door being movable between a latched position restricting access to the wash chamber and an unlatched position permitting access to the wash chamber;

a sensor assembly mounted to the door to detect a position thereof; and a controller operably coupled to the sensor assembly, the controller being configured to initiate a detection operation comprising determining, outside of a discrete washing operation comprising a circulation cycle and a drain cycle, a future-use chamber cycle (FCC) to be initiated at a delayed time period, detecting the door in the unlatched position at the sensor assembly outside of the discrete washing operation, generating a door-alert signal in response to detecting the door in the unlatched position, and restricting initiation of the FCC following generating the door-alert signal.

2. The dishwashing appliance of claim 1, wherein the FCC comprises an automated rinse cycle having a set time interval of inaction within the wash chamber, wherein the delayed time period is at expiration of the set time interval.

3. The dishwashing appliance of claim 1, wherein the FCC comprises a delayed wash cycle, and wherein determining the FCC comprises receiving a user-input signal from a user interface of the dishwashing appliance to manually schedule the delayed wash cycle.

4. The dishwashing appliance of claim 1, wherein the FCC comprises a predicted wash cycle, wherein determining the FCC comprises evaluating past-use data of the dishwashing appliance and identifying a common cycle time based on the evaluation of the past-use data, and wherein the delayed time period matches the common cycle time.

5. The dishwashing appliance of claim 1, wherein detecting the door in the unlatched position comprises detecting the door in an open position.

6. The dishwashing appliance of claim 1, wherein detecting the door in the unlatched position comprises detecting a latch member apart from a catch member.

7. The dishwashing appliance of claim 1, wherein the door-alert signal is configured to initiate a visual alert at a user interface of the dishwashing appliance.

8. The dishwashing appliance of claim 1, wherein the door-alert signal is configured to initiate an audible alert at a user interface of the dishwashing appliance.

9. The dishwashing appliance of claim 1, wherein the door-alert signal is transmitted to a remote user device in wireless communication with the dishwashing appliance, and wherein the door-alert signal is configured to initiate a visual alert at the remote user device.

10. The dishwashing appliance of claim 1, wherein the detection operation further comprises determining an unloaded detergent condition within the dishwashing appliance prior to generating the door-alert signal, and generating a detergent alert signal in response to determining the unloaded detergent condition within the dishwashing appliance.

* * * * *